US005761881A

United States Patent [19]

Wall

[11] Patent Number: 5,761,881

[45] Date of Patent: Jun. 9, 1998

[54] PROCESS AND APPARATUS FOR WRAPPING PAPER ROLLS

[76] Inventor: Benjamin Wall, 19984 Woodlake Rd., Pierson, Mich. 49339

[21] Appl. No.: 782,821

[22] Filed: Jan. 13, 1997

Related U.S. Application Data

[63] Continuation-in-part of Ser. No. 438,910, May 10, 1995, abandoned.

[51] Int. Cl.[6] ..... B65B 61/00; B65B 11/00

[52] U.S. Cl. ..... 53/415; 53/465; 53/136.2; 53/211

[58] Field of Search ..... 53/415, 462, 465, 53/136.2, 136.3, 206, 376.5, 377.7, 372.9, 211

[56] References Cited

U.S. PATENT DOCUMENTS

| | | |
|---|---|---|
| 2,797,804 | 7/1957 | Pomeroy et al. . |
| 2,974,460 | 3/1961 | Walther et al. . |
| 3,066,848 | 12/1962 | Billeb . |
| 3,523,050 | 8/1970 | Campbell . |
| 3,924,375 | 12/1975 | Brenner et al. . |
| 3,942,638 | 3/1976 | Stone . |
| 4,137,690 | 2/1979 | Morgan . |
| 4,185,742 | 1/1980 | Fisk et al. . |
| 4,201,028 | 5/1980 | Melehan . |
| 4,265,954 | 5/1981 | Romanek . |
| 4,578,925 | 4/1986 | Matsunami . |
| 4,679,376 | 7/1987 | Ekblom . |
| 4,820,374 | 4/1989 | Lamb . |
| 5,090,566 | 2/1992 | Yount . |
| 5,392,592 | 2/1995 | Bozich et al. . |

FOREIGN PATENT DOCUMENTS

| | | |
|---|---|---|
| 2147277 | 5/1973 | Germany . |

*Primary Examiner*—Linda Johnson
*Attorney, Agent, or Firm*—Waters & Morse PC

[57] ABSTRACT

An apparatus for wrapping paper rolls as a roll handler to position a roll, a wrapping mechanism that applies a side wrapper, a header applicator that places a header against an end of the roll, and a pressure mechanism with one of a heated roller or a cooled roller that presses the outer portions of the header against the side of the roll. The heat or cooling and the pressure induce rapid bonding connection of the outer portions of the header with the side of the roll. Similarly, the process includes the steps of positioning a roll header against an end of the roll and axially rotating the roll relative to a fastening mechanism that includes a deflection mechanism that folds the outer portion of the header over against the roll, an adhesive mechanism that disposes an adhesive between the outer portion of the header and the side of the roll, and one of a heated pressure mechanism or a cooled pressure mechanism that presses the outer portion of the header against the side of the roll with the heat or cooling and the pressure inducing rapid bonding connection of the outer portion of the header with the side of the roll.

18 Claims, 5 Drawing Sheets

PROCESS AND APPARATUS FOR WRAPPING PAPER ROLLS

CROSS-REFERENCES TO RELATED APPLICATIONS

This is a continuation in part application of U.S. patent application Ser. No. 08/438,910, now abandoned, entitled Process and Apparatus for Wrapping Paper Rolls and filed on 10 May, 1995 by Benjamin Wall, the disclosure of which is incorporated here by reference.

BACKGROUND OF THE INVENTION

The invention relates to a process and apparatus for wrapping large paper rolls and more particularly to a process and apparatus for applying a header to such rolls.

As is known in the prior art, large paper rolls of the type used for newsprint and the like are very heavy and may range from twenty-five to seventy-two inches in diameter. For storage and transport, the paper roll is protected from moisture, atmosphere, and physical abrasions by being wrapped in a moisture resistant, protective wrapping that covers the sides and ends of the rolls. The rolls are then stored on end and stacked, one on top of the other. Specialized machinery is employed to automatically apply the protective wrapping, typically paper, to the large rolls.

Various methods have been used to apply wrapping paper to paper rolls. In one of the most common methods of wrapping paper rolls, one or two layers of a protective wrapping paper is wrapped around the sides of the roll, with the wrapping paper being longer than the rolls and extending outwardly beyond the ends of the roll. Next, interior or inner roll headers (discs formed of corrugated cardboard, chipboard, or laminated kraft paper) are fitted inside the wrapping paper and against the ends of the roll. The wrapping paper is then crimped over the edges of the interior headers, at the ends of the roll, using a crimping wheel A set of exterior or outside roll headers (commonly discs made of a kraft paper with a poly coating on the inside surface, that are typically thinner than the inner roll headers) are then attached to the ends of the roll, over the crimped edges. The headers and the wrapping paper are held in place and affixed to one another by applying a heated plate to the outside header until the poly coating (a heat activated adhesive) melts and affixes the outside roll headers to the crimped portions of the wrapping paper and to the inside roll header. The heat plate is fabricated with vacuum openings to hold the header while pressing it against the end of the roll.

As pointed out in applicant's prior U.S. Pat. No. 5,392,585, entitled Rolled Paper Header Plate and issued on 28 Feb. 1995, a problem with the conventional method for wrapping paper rolls is that when the wrapping paper is crimped over the ends of a roll, the wrapping paper overlaps onto itself and forms raised areas or ridges in the wrapper When these rolls are stored on their ends and one roll is stacked upon another, the extreme weight of the heavy paper rolls causes these ridges to be permanently indented into the ends of the soft paper rolls. These indentations are a disadvantage and can cause the paper to tear when unrolled or can cause a paper break on a printing press or the like, which causes down time Additionally, as a result of the ridges, a distorted edge can be produced in the final paper product.

Another problem with prior methods for affixing headers is that air can be trapped inside the roll when placing the inside headers in position. When the headers are pressed into place, the air is compressed, and thus can cause the wrapper to rupture.

The present invention provides a process and apparatus for automatically wrapping a large paper roll efficiently and economically while overcoming the foregoing problems, including the problems of making ridges in the wrapping paper that covers the ends of the rolls.

SUMMARY OF THE INVENTION

In accordance with the present invention, a process for wrapping a large paper roll comprises wrapping the sides of the roll with a wrapper that extends almost to but not over the ends of the roll. A roll header having an outer diameter greater than the diameter of the roll is positioned against the end of the roll. The portion of the header extending beyond the periphery of the roll is then folded over against the roll and adhesively fastened to the wrapping paper on the sides of the roll. The folding and fastening are accomplished in a continuous process by pressing the header against the end of the roll and rotating the header and the roll past a relatively stationary fastening mechanism that folds the outer portion of the header over against the wrapper on the sides of the roll, activates or applies an adhesive to the mating surfaces of the outer portion of the header and the wrapper and presses the mating surfaces together until the adhesive bonds the surfaces together While a number of adhesives will work satisfactorily with the present invention, a thermoplastic polymer (called "poly" in the trade) on the inner surface of the outer portion of the header provides a heat-activated adhesive that works satisfactorily. The polymer may be activated by one or a combination of a hot air blower, heat lamp, or heated roller. The poly may be activated before the outer portion is folded down or after the portion has folded down over the wrapper. Desirably, the outer portion is pressed against the wrapper and held into place until the poly sets or cools so as to form a bond.

A convenient method for producing a header having a poly coating on the outer portion without having a poly surface on an inner portion that could rub off on or bond to the end of the paper roll itself is by laminating a poly coated exterior header to an interior header, wherein the diameter of the interior header is approximately the diameter of the paper roll and the diameter of the exterior header is larger.

Other adhesives also will work with the present invention. The adhesive may be pre-applied and part of the header or wrapper or the adhesive may be applied during the wrapping process. A liquid adhesive can be applied to the outer portion of the header or to the wrapper itself as the roll is rotated past an adhesive application station. An adhesive could be pre-applied to the ends of the paper wrapper as well as to the header.

A desirable feature of the header is that the outer portion is serrated or notched inwardly almost to the periphery of the roll, so that the header does not overlap onto itself when it is folded downwardly against the wrapping paper. This provides a better bond and also prevents ridges in the header from being impressed into the sides of the roll.

The process of the present invention is incorporated into a continuous operation wherein specialized machinery quickly and automatically applies and affixes the headers with a minimum of human intervention.

These and other features of the present invention are described in more detail below and shown in the appended drawings These and other features, objects, and benefits of the invention will be recognized by one having ordinary skill in the art and by those who practice the invention, from the specification, the claims, and the drawing figures.

DESCRIPTION OF THE PREFERRED EMBODIMENTS

Figure 1:
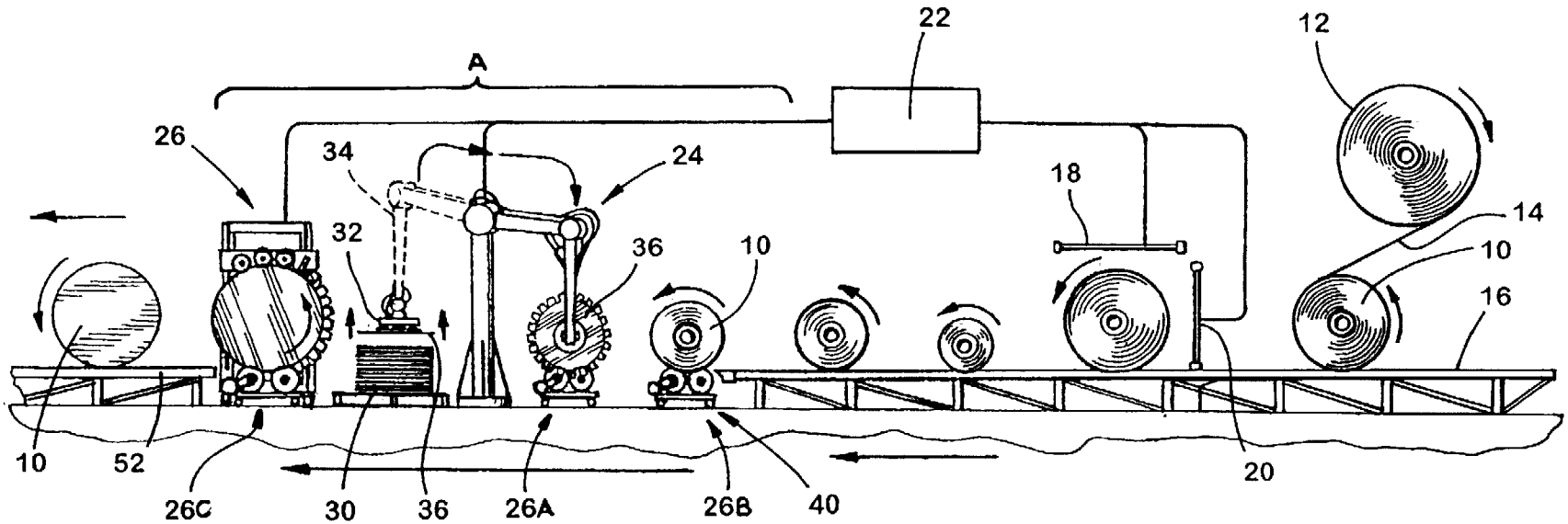
FIG. 1 is a schematic side view of an automated paper roll wrapping system employing the process and apparatus of the present invention.

Referring now to the drawings, a paper roll 10 is shown in FIG. 1 being subjected to an automatic wrapping process in accordance with the present invention. In the process, an automatic paper wrapper application mechanism 12 applies a paper wrapper 14 to the outer cylindrical surface of paper roll 10. Wrapper 14 extends up to but not over the ends of roll 10 and preferably terminates just short of each end of the roll 10. Generally, the application of a paper wrapper to the side of paper roll 10 is conventional. A principal difference in the present invention is that the wrapper 14 does not beyond and overlap the ends of the roll 10.

For exemplary purposes, the roll 10 is shown on a gravity conveyor 16 and moves along the conveyor in a right to left direction in FIG. 1, from a wrapping station at 5 the right side of FIG. 1, to a head application station "A" toward the left side of FIG. 1. Further, the bracketed portion "A" of FIG. 1, downstream of conveyor 16, includes three drawings of one header application station apparatus with each drawing representing a different time period in the process. For convenience, all of the paper rolls are referred to as if they were a single roll 10 moving along the conveyor system.

After the wrapper 14 is applied to the roll 10, one header 36 is positioned on one of the two ends of the roll 10, and a second header 36 is positioned on the other of the two ends of the roll 10. This may be done manually or automatically FIG. 1 depicts an automatic operation wherein sensors 18 and 20 detect the size of the roll 10 (before or after wrapping) and send an electrical signal representative of this size to a signal processor or control mechanism 22, which in turn controls operation of a header handling robot 24 and a header application mechanism 26 according to the indicated size of the roll 10.

The header robot 24 selects an appropriate sized header 36 from a predetermined one several header stack 30, picks up a header 36 with a robotic vacuum head 32 on the end of a manipulatable arm 34, and moves the header 36 from the stack 30 to a position adjacent a vacuum holder mechanism 38 of the header applicator 26 (FIGS. 1–4). The header applicator is designated by numeral 26A in FIG. 1, at the time period when the header 36 is positioned on the applicator 26.

After the header 36 is automatically or manually positioned on the vacuum holder 38, the roll 10 is rotated on a powered roller table 40. Roller table 40 comprises a pair o f rollers 42 and 44 that are rotatably mounted and spaced laterally apart on a frame 46. One of the rollers is powered by a suitable drive mechanism 48 and a belt or chain drive 50 or the like (FIG. 2), as is known. When the roller table 40 is actuated, the roll 10 is rotated about its cylindrical axis and held in a relatively fixed longitudinal position on the conveyor 16. The movement of the roll 10 onto the roller table 40 is indicated by numeral 26B on FIG. 1.

The roller table 40 is preferably constructed so the end of the roll 10, to which the header is applied, extends about four inches (100 mm) beyond the rollers 42 and 44. This eliminates damage to the tabs 132 on outer roll headers 36 when the roll 10 is rotated to seal and crimp the tabs 132.

Fastening of the header 36 to the end of the roll 10 is depicted by numeral 26C in FIG. 1, wherein the header 36 is bonded to the end of the roll 10. After this step, roll 10 is discharged onto a conveyor or storage platform 52 for delivery and storage.

Figure 2:
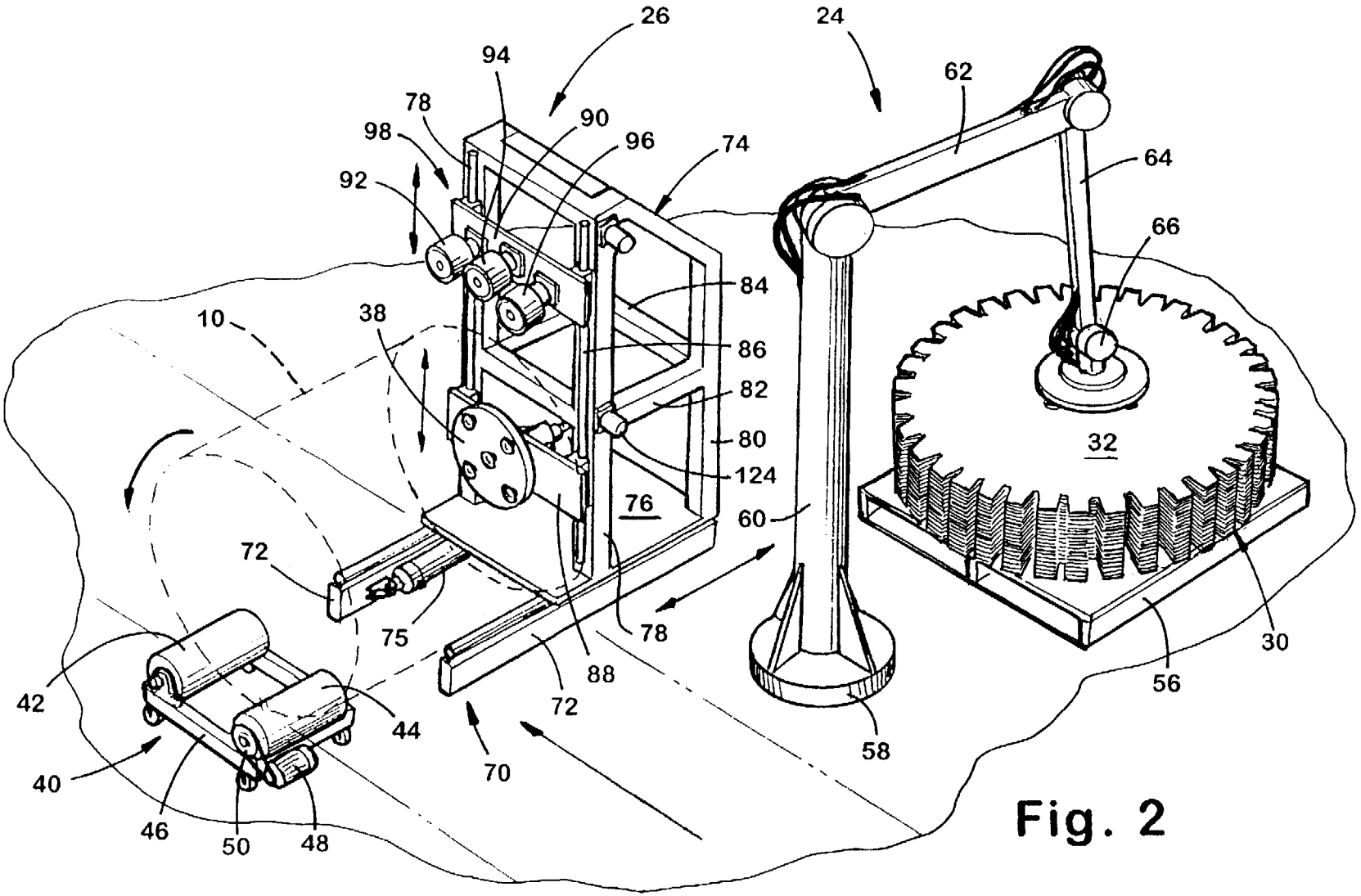
FIG. 2 is a perspective view showing the header application apparatus of the present invention.

Referring to FIG. 2, robot 24 picks up headers 36 from stack 30. The headers 36 may be supplied to the robot 24 on a pallet 56 or the like. The robot 24 orients a selected header 36 into a vertical plane and places the header 36 onto the vacuum holder 38, where the header 36 is retained until applied to the end of a roll 10.

Robot 24, shown schematically, includes a base 58, with a vertical support member 60 extending generally upward up from the base to an arm 62. The arm 62 extends outward from the top of support member 60 to a depending arm 64. The arm 62 is adapted to swing about support member 60 and to pivot generally vertically. The depending arm 64 is movably mounted on an outer end of arm 62 and extends to a vacuum pick-up head 32 on its outer end.

Header applicator 26 comprises a fixed base 70 that has parallel base rails 72. A frame 74 is slidably mounted on the rails to move in an axial direction, generally parallel with the rails 72, toward and away from the roller table 40. A hydraulic cylinder 75 is preferably used to slide the frame 74 to apply a header 36 from the vacuum holder 38 to the end of a roll 10.

The frame may have a base platform 76 or the like, with two front upright supports 78 and two rear upright supports 80 extending generally upward from the base 76. The upright supports 78 and 80 may be connected by cross members 82 and 84 and the like. The front upright supports 78 have key ways or tracks 86 or the like, to guide a mounting plate 88 of the vacuum holder 38 and a mounting plate 90 of a header fastening mechanism 98. Each of the mounting plate 88 and the mounting plate 90 are slidably connected with and supported by the front upright supports 78, via the tracks 86, to slide generally vertically along the tracks 86. The header fastening mechanism 98 is positioned above the vacuum holder 38, as shown, and may have three rollers 92, 94 and 96 as shown in the embodiment of FIG. 2. The header fastening mechanism 98 and the vacuum holder 38 arc vertically adjustable on frame 74 so the header applicator 26 can be adjusted to accommodate paper rolls of different sizes.

Only one side of the header applicator procedure is shown in the drawing figures. Another header applicator mechanisms 26 and robot 24, identical to the ones described above and shown in FIG. 2, are positioned downstream of the first mechanism 26 and robot 24 to perform an identical function in fastening a header to the second, opposing end of the roll 10. These two header applicator mechanisms 26 and robots 24 are positioned at longitudinally separated positions on the conveyor line and perform their functions sequentially. Of course, one having ordinary skill in the art will appreciate that the two header applicator mechanisms 26 and robots 24 may also be combined into a single station device, rather than the sequential, two station devices that are specifically shown and described.

Figure 3:
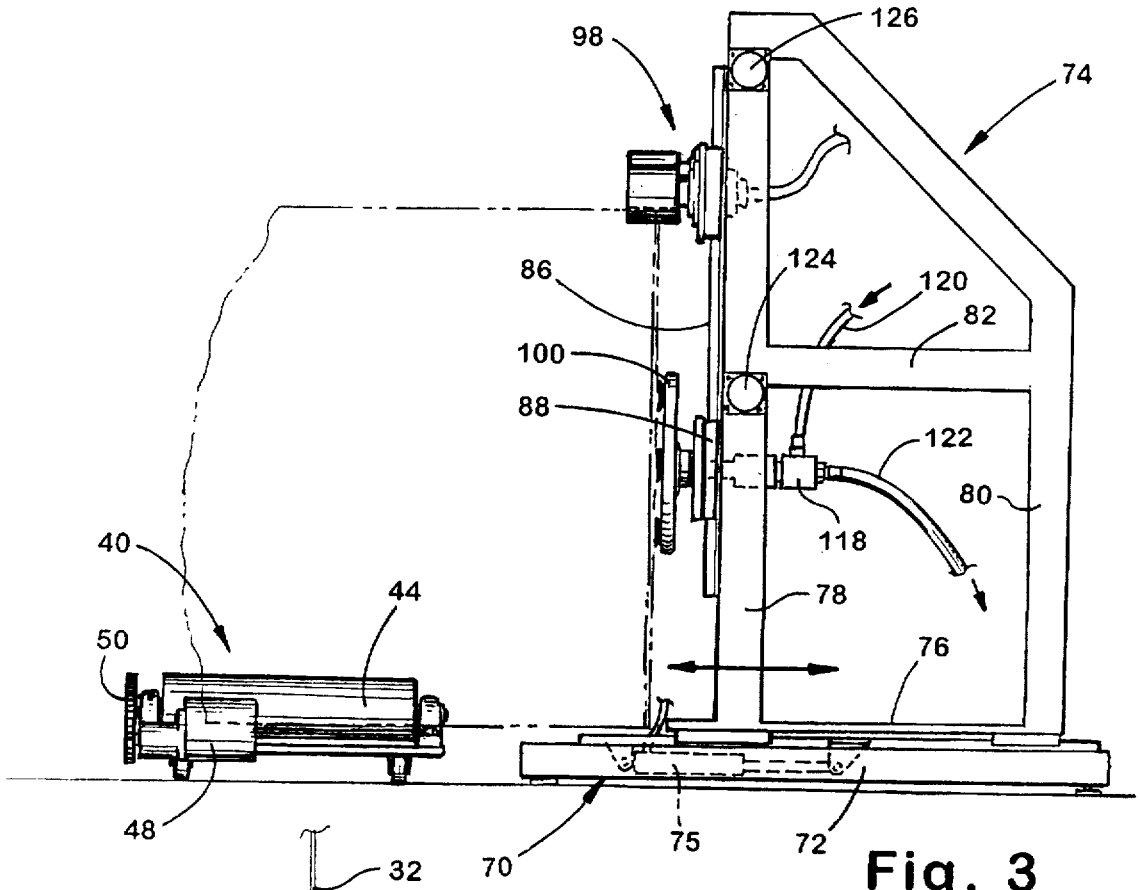
FIG. 3 is a side elevational view of the header application apparatus of the present invention.
Figure 4:
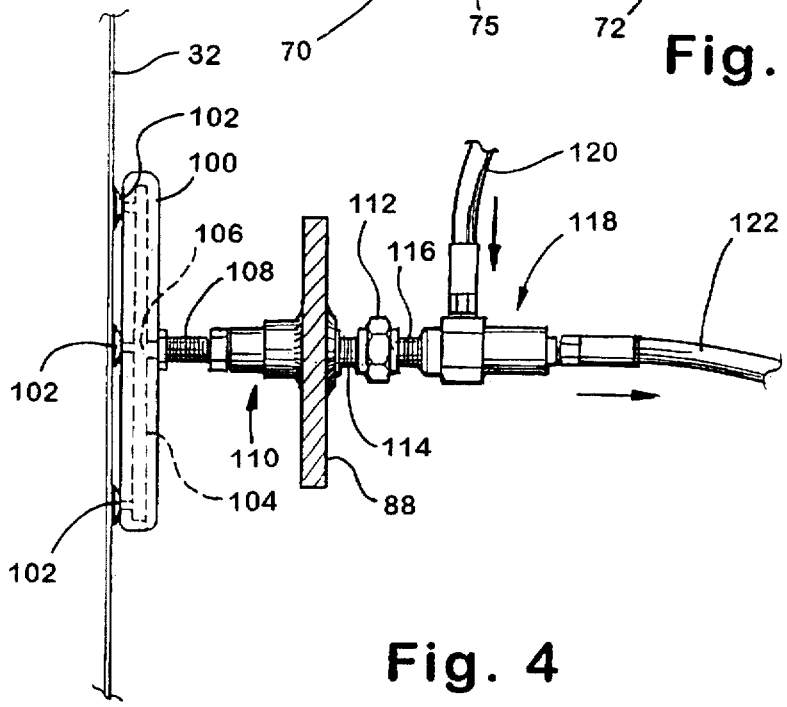
FIG. 4 is a side elevational view of the vacuum operated header holding device of the present invention.

The details of the vacuum holder mechanism 38 are shown in FIGS. 3 and 4. A hollow vacuum plate 100 comprises a plurality of vacuum outlet openings 102. The vacuum outlet openings 102 are connected by an internal plenum 104 to an outlet opening 106. A hollow shaft 108 couples with the outlet opening 106 and is connected to mounting plate 88 by a rotary coupling 110. By use of rotary coupling 110, vacuum plate 100 and shaft 108 may rotate with respect to mounting plate 108 while still permitting a vacuum to be drawn through the vacuum plate 100.

A vacuum pump 118 may be connected with rotary coupling 110 by a union 112 and hollow shafts 114 and 116, as is specifically shown, or by other piping arrangements as will be appreciated by one having ordinary skill in the art. Desirably, the vacuum pump 118 is a venturi type pump, wherein air is received through inlet conduit 120 and discharged through outlet conduit 122 while at the same time drawing a vacuum in the internal chamber 104 of the vacuum plate 100. The vacuum drawn through the vacuum plate 100 causes a header 36 to be held by vacuum to the vacuum plate 100.

Alternatively, when the paper rolls 10 are generally all of the same size, mounting plate 88 can be bolted in place on track 86 by means of a series of vertically spaced holes in vertical support member 78 or the like. Where continuous adjustment is desired, an automatic drive that varies the position of the plate 88 on support member 78 is desirable. A motorized worm gear 124 is shown in FIGS. 2 and 3. This worm gear is interconnected with the mounting plate 88 to adjust it upward and downward. The worm gear motor can be actuated manually or, more preferably, can receive an automatic position adjusting signal from the control mechanism 22.

The header fastener assembly 98 is a heater and crimper assembly. The header fastener assembly 98 is mounted on the upper portion of frame 74 and can be bolted in place or be adjusted electrically by a motorized drive 126 such as a worm gear drive or the like, similar to the mounting plate 88, discussed above.

Several types of devices can be used for crimping and adhesively securing an outer portion of the header 36 to the wrapper 14 on the sides of the rolls 14. The header fastener assembly 98 includes three separate functions. A first function is deflection or folding of the tabs 132 on the outer portion of the header. The tabs 132 are deflected and folded over against the sides of the roll 10, wherein corresponding mating surfaces of the wrapper 14 and the tabs 132 brought into engagement.

Figure 6:
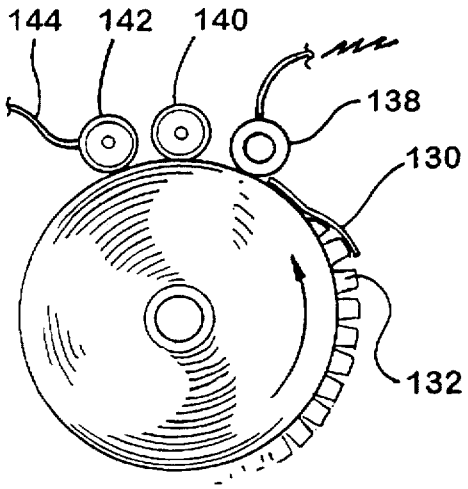
FIG. 6 is a schematic view of the same type shown in FIG. 5 wherein a deflection plate is employed for folding the tabs over onto the sides of the roll and three rollers are employed for pressing the tabs against the roll, with the first roller being heated for the purpose of activating the thermoplastic adhesive and the third roller being cooled.

In FIG. 6, the deflection mechanism comprises a deflection plate 130. The deflection plate 130 is curved and sloped to engage the notched tabs 132 when they rotate into contact with the plate 130, and to bend the notched tabs 132 over, into a flat position, against and engaging the wrapper 14.

Figure 5:
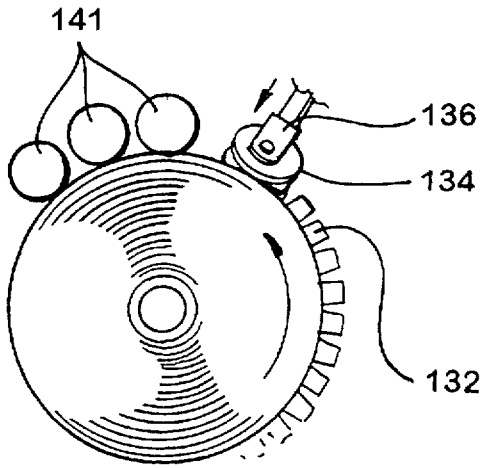
FIG. 5 is a schematic view showing the use of an inclined heated V-shaped wheel as the deflection mechanism for folding the notched tabs at the outer portion of the header over onto the sides of the roll.

More preferably, as shown in FIG. 5, an inclined, V-shaped wheel 134 is rotatably mounted on a support member 1.36 that is rigidly attached to frame 74. The wheel 134 rides on an edge of the roll 10 to engage and fold the tabs 132 over, against the side of the roll 10, while the roll 10 rotates by the wheel 134. The V-shaped wheel 134 is an important feature of the present invention.

In one aspect of the invention, the header 36 is coated with a heat activated adhesive, such as known thermoplastic polymer adhesives, that is non-sticky at normal temperatures and liquifies when heated. Such products are known and are conventionally used to affix headers on paper rolls. The entire header 36 may be coated with the heat activated adhesive. More preferably, the header 36 may be lamination with inner and outer header layers that are separated by a layer of the adhesive. The inner and outer header layers may be constructed of common header materials, or other suitable substitutes. Preferably, the inner header layer is a circular member sized about the same, not larger than, the end of a paper roll 10. The outer header layer is sized larger than the inner header layer to define the tabs 132 at a perimeter of the outer header layer. An inner side of the outer header layer is substantially covered with a layer of the adhesive. The inner header layer is concentrically positioned against the inner side of the outer header layer, with application of heat to adhere the two header layers together. With the inner side of the outer header layer being substantially covered with a layer of the adhesive, the inner header layer being concentrically positioned against the outer header layer, and the outer header layer being sized larger than the inner header layer, an annular portion that is substantially covered with a layer of the adhesive is defined between the perimeters of the two header layers. The annular portion that is defined between the perimeters of the two header layers is most preferably notched to define the tabs 132.

In prior methods of affixing roll header to a roll 10, the wrapping is crimped over the end of the roll 10 and an outer header is bonded to the crimped wrapper This is not desirable because the crimped wrapper does not let the outer header make proper contact with the inside header. Thus, the outer headers can get torn off in shipment or handling and not provide the protection needed. There is only a 25–30 percent inside header bond area with the prior system, whereas the present invention provides a 95–100 percent bond to the inside header.

When a pre-applied heat activated adhesive is used in the header, the present invention employs an adhesive mechanism that heats the thermoplastic adhesive to its melting temperature and then holds the two mating surfaces in contact until the temperature of the adhesive falls to the point where a bond is formed.

In FIG. 6, the adhesive mechanism comprises two heated rollers 138 and 140 that are heated by electricity or the like, and two no n i-heated rollers 142. If desired, the non-heated rollers 142 could be cooled to cool the adhesive to a setting temperature more quickly than might otherwise occur. By heating and cooling the adhesive quickly, the paper roll 10 may be rotated faster and the header attached to the end of the roll 10 more quickly. A suitable refrigeration conduit 144 is shown schematically in FIG. 6.

Figure 7:
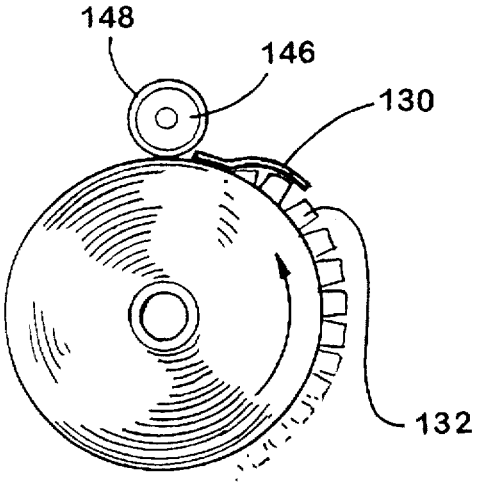
FIG. 7 is a schematic view showing a roll employing a deflection plate for folding the tabs downwardly onto the side of the roll and a single roller for pressing the tabs against the roll.

FIG. 7 shows another embodiment of the adhesive mechanism of the present invention, wherein a single large roller 146 is employed downstream from the deflection plate 130. The roller is coated with a layer of foam rubber 148 or the like that provides firm, cushioned contact between the roller and the mating surfaces of the header 36 and wrapper 14. Roller 146 is desirably heated to activate the thermoplastic adhesive immediately after the notched tabs 132 are folded down, against the sides of the wrapper 14.

Figure 8:
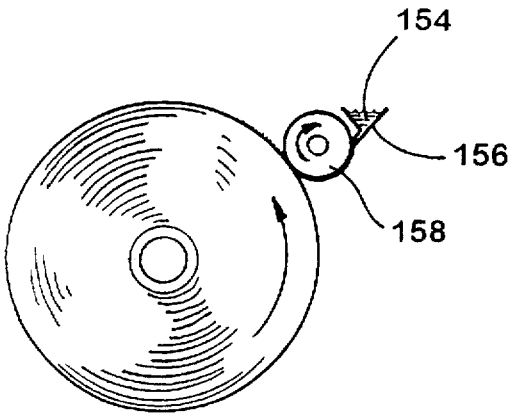
FIG. 8 is a schematic view showing the application of a liquid adhesive by means of a rotating wheel that applies the adhesive to the ends of the wrapper.
Figure 9:
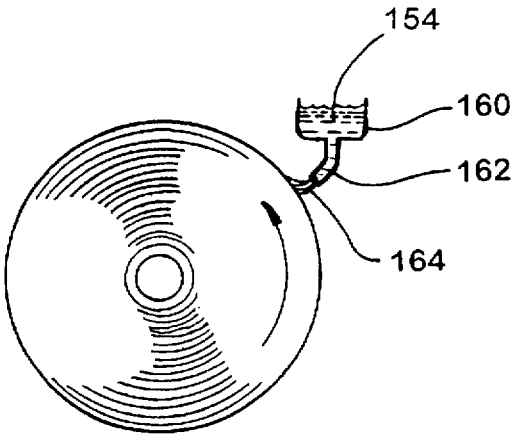
FIG. 9 is a schematic view showing a liquid adhesive application device for applying a liquid adhesive by a brush to the ends of the wrapper.
Figure 10:
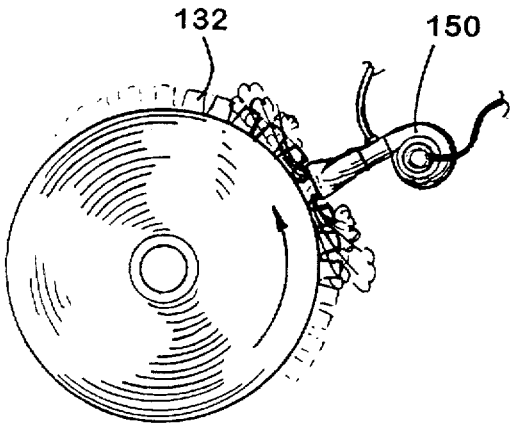
FIG. 10 is a schematic view showing the use of a hot air blower for activating a poly adhesive on the notched outer portion of the header.
Figure 11:
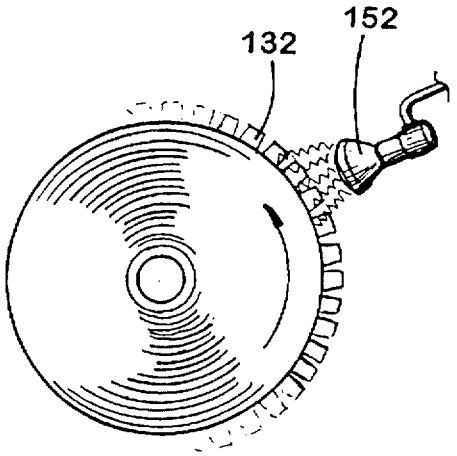
FIG. 11 is a schematic view showing the use of a heat lamp for activating the poly coating on the notched outer portion of the header.

FIGS. 8–11 show various additional ways in which adhesive may be applied or activated during the wrapping procedure in the present invention. In FIG. 10, hot air is used to activate the adhesive on tabs 132. In FIG. 11, a heat lamp 152, such as an infrared light, can be used to activate an adhesive on the notched tabs 132, at the outer portions of the header. Light curing adhesives could also be used, with the light 152 providing visible light or ultraviolet light as appropriate for any given light cured adhesive, in order to activate the bonding process.

For rapid roll rotation using a heat activated adhesive, hot air heat and V-shaped crimp wheel 134 are most preferable to expedite the wrapping process. One or multiple sealing wheels 138 and 140, positioned rotationally after the crimp wheel 134, may be used to assure good contact of the tabs 132 with the wrapper 14. The sealing wheels 138 and 140 may be heated or cooled to facilitate the adhesive process, depending on the characteristics of the specific heat activated adhesive that is used.

The application of liquid adhesives is shown schematically in FIGS. 8 and 9. A liquid adhesive 154 contained in a reservoir 166 is fed gradually onto a rotating application wheel 158 in FIG. 8. The application wheel bears against the wrapper 14, slightly away from the end of the wrapper 14, and thus applies a ring of liquid adhesive around the wrapper 14. The tabs 132 are folded over and pressed against the adhesive until such time as the adhesive bonds sufficiently to hold the two surfaces together.

In FIG. 9, liquid adhesive 154 in reservoir 160 communicates with an outlet tube 162 leading to a brush or nozzle applicator 164, which gradually applies adhesive to the wrapper 14, a short distance from the end of the roll 10.

Again, the notched tabs 132 forming the outer position of the header 36 are folded over and pressed against the wrapper 14 in the same manner as shown in FIGS. 5–7, with the pressure being accompanied by heat or light or whatever is required to activate or cause the selected adhesive to hold the mating surfaces together.

The important factors in choosing an appropriate adhesive mechanism for use in the present invention is the rate at which the adhesive can be activated and the rate at which the adhesive will set with the appropriate input of heat or other stimulant. With the present invention, an important feature is the ability of the header applicator 26 to apply a header 36 and fix it into position quickly in a continuous production line process without having the roll 10 maintained at the header application station for a long period of time. Thus, it is important that the adhesive mechanism of the present invention be capable of applying an adhesive or activating a pre-applied adhesive quickly as the roll 10 rotates past the activation mechanism. At the same time, it is important that the adhesive reacts quickly to bond the surfaces together as the roll 10 passes by the pressure bonding mechanism of the present invention.

In a preferred practice of the present invention, a heat activated adhesive, such as a thermoplastic that is known as "poly", is used. One to three pressure rollers 141 may be applied to hold the tabs 132 against the wrapper 14 with an about one to about five pounds per square inch pressure, after the tabs 132 are bent over, onto the wrapper 14 by the V-roller 134. The pressure rollers 141 may be heated, cooled, or neither, depending upon the particular adhesive used and upon other specific elements of the installed invention, as will be understood by one having ordinary skill in the art. This preferred practice allows application and bonding of a roll header 36 in about 15 seconds or less.

More particularly, hot air heat activation of the adhesive to quickly raise the temperature of the heat activated adhesive to about 500 to about 700 degrees fahrenheit is preferred to expedite the header application process. Folding of the tabs 132 onto the wrapper 14 is best accomplished with the V-roller 134, which quickly lays the tabs 132 onto the wrapper 14 without dragging and damage. Use of curved plates and the like is typically not satisfactory because friction between the plate and the header tabs 132 may cause the tabs 132 to drag on the plate and become deformed. While some delay may be necessary between heating of the heat activated adhesive and crimping and pressing of the tabs 132 against the wrapper 14, use of successively canted flat rollers and the like is also not typically acceptable because the adhesive will often be too cool before the tabs 132 are pressed to the wrapper 14. The crimping, or folding of the tabs 132 against the wrapper 14, should be made within about three seconds of heat activation of the adhesive, and more preferably in about one half to about one second.

Preferably, the conveyor 16 on the upstream side of the header applicator apparatus 26 is a gravity conveyor that permits the rolls 10 to roll downward to the powered roller mechanism 40. The conveyor 52 at the downstream end of the header applicator apparatus 26 may also be a gravity conveyor or it can be a flat loading platform, where the rolls are retained.

With the present invention, rolls are wrapped rapidly, tightly, and in a water-resistant manner with an improved end seal and without impressing ridges or indentations that damage the ends of the rolls. In addition, because there are no ridges, an inner header can be completely dispensed with and a single, relatively light weight header can be used in its place. This provides a considerable cost savings. There is about a ten percent (10%) savings in roll wrapper material by eliminating the portion that is crimped over the ends of the roll 10. Also, in some instances the inside header can be totally eliminated, which provides further cost savings.

It will be understood by one having ordinary skill in the art and by those who practice the invention, that various modifications and improvements may be made without departing from the spirit of the disclosed concept. The scope of protection afforded is to be determined by the claims and by the breadth of interpretation allowed by law.

I claim:

1. A process for wrapping a large paper roll comprising the steps of:

providing a paper roll, the paper roll having a roll surface and two opposing roll ends;

providing wrapper, the wrapper having a width that is sized to extend between the roll ends;

providing a header, the header having an inner portion that corresponds to the roll ends, having an outer portion that extends radially outward from the inner portion, and having an inside surface, the outer portion being notched to define an array of tabs that extend radially outward from the inner portion;

providing a layer of heat activatable adhesive that is disposed on the inside surface of the tabs of the header;

providing a hot air heater to heat activate the adhesive;

positioning the heater relative to the roll to sequentially heat the tabs when the header is positioned against a roll end and the roll is rotated, the heater being adapted to blow hot air onto the tabs;

providing a V-roller;

positioning the V-roller relative to the roll to sequentially fold the tabs and press the tabs against the roll surface when a header is positioned against a roll end and the roll is rotated;

wrapping the roll surface with the wrapper, the wrapper extending between the roll ends;

then positioning a roll header a against a roll end after the roll surface is wrapped;

then rotating the roll after a roll header is positioned against a roll end;

then sequentially heat activating the adhesive on the tabs, by blowing hot air from the heater onto the tabs, when the roll is rotated; and then sequentially folding and pressing the tabs over against the wrapper on the roll surface, with the V-roller, after the adhesive is heat activated.

2. The process according to claim 1 wherein the step of providing the header further includes providing two concentric circular layers of header material, with an inner header layer that corresponds to the roll ends, having a diameter of about the diameter of the roll, and an exterior header layer having a larger diameter that extends radially outwardly beyond the periphery of the inner header layer, and that defines the tabs, the inner and the exterior header layers being laminated together by a an adhesive between the layers.

3. The method of claim 1 wherein the step of sequentially folding and pressing the tabs against the wrapper, is performed from about a quarter of a second to about four seconds after the adhesive is heat activated.

4. The method of claim 1 wherein the step of providing a heater to heat activate the adhesive, further includes the step of providing the heater with a number of hot air heaters.

5. The method of claim 4 wherein the step of providing a number of hot air heaters, further includes positioning the number of hot air heaters to one of sequentially heat the tabs, and heat the tabs concurrently.

6. The method of claim 4 wherein the step of providing a number of hot air heaters, further includes providing a heater control to selectively activate any of the number of hot air heaters.

7. An apparatus to wrap paper rolls, each paper roll having a roll surface extending between two opposing roll ends, and an axis extending through the ends, the apparatus comprising:

a roller to support a paper roll and rotate the paper roll about the axis;

a header applicator positioned proximal to the roller to position and hold a roll header against a roll end so the header will rotate with the paper roll;

a header positioned proximal to the header applicator, the header having an inner portion that corresponds to the roll ends, having an outer portion that extends radially outward from the inner portion, and having an inside surface, the outer portion being notched to define an array of tabs that extend radially outward from the inner portion, and a layer of heat activatable adhesive disposed on the inside surface of the tabs;

a hot air heater positioned proximal to the roller to heat activate the adhesive; and a V-roller positioned proximal to the roller to sequentially fold and press the tabs against the roll surface when the roll is rotated.

8. The apparatus of claim 7, wherein the V-roller is positioned relative to the hot air heater and the rotation of the roll, so the tabs are sequentially folded and pressed against the wrapper from about a quarter of a second to about four seconds after the adhesive is heat activated.

9. The apparatus of claim 7, wherein the hot air heater includes a number of hot air heaters.

10. The apparatus of claim 9, wherein the number of hot air heaters are positioned to one of sequentially heat the tabs, and heat the tabs concurrently.

11. The apparatus of claim 9, wherein the heater further includes a heater control that selectively activates any of the number of hot air heaters.

12. The apparatus of claim 7, wherein the header further has two concentric circular header layers, including an inner header layer that corresponds to the roll ends, and an exterior header layer that extends radially outward beyond the inner header layer to define the tabs, the inner header layer being adhered to the exterior header layer.

13. A method to wrap a paper roll with a wrapper and a header, the roll having a roll surface and two opposing roll ends, the wrapper having a width that is sized to extend between the roll ends, the header having an inner portion that corresponds to the roll ends, having an outer portion that extends radially outward from the inner portion, and having an inside surface, the outer portion being notched to define an array of tabs that extend radially outward from the inner portion, the method comprising the steps of:

providing a layer of heat activatable adhesive that is disposed on the inside surface of the tabs of the header;

providing a hot air heater to heat activate the adhesive, the heater being positioned relative to the roll to sequentially heat the tabs when the header is positioned against a roll end and the roll is rotated, the heater being adapted to blow hot air onto the tabs;

providing a V-roller, the V-roller being positioned relative to the roll to sequentially fold the tabs and press the tabs against the roll surface when a header is positioned against a roll end and the roll is rotated;

wrapping the roll surface with the wrapper, the wrapper extending between the roll ends;

then positioning a roll header against a roll end after the roll surface is wrapped;

then rotating the roll after a roll header is positioned against a roll end;

then sequentially heat activating the adhesive on the tabs, by blowing hot air from the heater onto the tabs, when the roll is rotated; and then sequentially folding and pressing the tabs against the wrapper, with the V-roller, after the adhesive is heat activated.

14. The method of claim 13 wherein the step of sequentially folding and pressing the tabs against the wrapper, is performed from about a quarter of a second to about four seconds after the adhesive is heat activated.

15. The method of claim 13 wherein the step of providing a heater to heat activate the adhesive, further includes the step of providing the heater with a number of hot air heaters.

16. The method of claim 15 wherein the step of providing a number of hot air heaters, further includes positioning the number of hot air heaters to one of sequentially heat the tabs, and heat the tabs concurrently.

17. The method of claim 15 wherein the step of providing a number of hot air heaters, further includes providing a heater control to selectively activate any of the number of hot air heaters.

18. The method of claim 13 wherein the step of providing the header further includes providing two concentric circular header layers, including an inner header layer that corresponds to the roll ends, and an exterior header layer that extends radially outward beyond the inner header layer to define the tabs, the inner header layer being adhered to the exterior header layer.

* * * * *